US006170483B1

(12) United States Patent
Ronjat

(10) Patent No.: US 6,170,483 B1
(45) Date of Patent: Jan. 9, 2001

(54) SELF-CONTAINED DIVING EQUIPMENT

(75) Inventor: Alain Ronjat, Delle (FR)

(73) Assignee: New Scaph Technology S.A. (CH)

( * ) Notice: Under 35 U.S.C. 154(b), the term of this patent shall be extended for 0 days.

(21) Appl. No.: 09/077,145

(22) PCT Filed: Nov. 25, 1996

(86) PCT No.: PCT/CH96/00414

§ 371 Date: Nov. 4, 1998

§ 102(e) Date: Nov. 4, 1998

(87) PCT Pub. No.: WO97/19848

PCT Pub. Date: Jun. 5, 1997

(30) Foreign Application Priority Data

Nov. 24, 1995 (CH) ..... 3334/95

(51) Int. Cl.[7] ..... B63C 11/02

(52) U.S. Cl. ..... 128/201.27; 128/201.11; 128/204.26; 128/205.22

(58) Field of Search ..... 128/201.11, 201.27, 128/204.26, 205.22

(56) References Cited

U.S. PATENT DOCUMENTS 2,488,261 * 11/1949 Bedini ..... 128/201.27
3,710,553 1/1973 Parker et al. ..... 55/316
4,380,232 4/1983 Doyle ..... 128/201.11
5,117,817 * 6/1992 Lin ..... 128/201.11
5,506,571 * 4/1996 Dugan ..... 340/626

FOREIGN PATENT DOCUMENTS

91/02677 3/1991 (WO) .

* cited by examiner

*Primary Examiner*—John G. Weiss
*Assistant Examiner*—Joseph F. Weiss, Jr.
(74) *Attorney, Agent, or Firm*—Ostrolenk, Faber, Gerb & Soffen, LLP

(57) ABSTRACT

Self-contained diving equipment comprising means (10) for refilling a compressed air tank (40) connected via a flexible air tube (1) to a snorkel and a breathing nozzle (70). The refilling means are deactivated when underwater, and an external air intake (61) is connected via a tube to the nozzle to feed air directly from the surface (10) when the swimmer is not underwater. The equipment further comprises a moisture removal device (20) and a filter (21) between the compressor (13) and the tank (40), as well as means (30) for controlling the activation and deactivation of the refilling means.

11 Claims, 2 Drawing Sheets

SELF-CONTAINED DIVING EQUIPMENT

BACKGROUND OF THE INVENTION

The present invention is in the field of apparatus making it possible to stay temporarily underwater and relates more particularly to self-contained diving equipment.

To allow a swimmer to explore the deep sea, the idea of using a tube connecting his nose or his mouth to the open air has long been in existence. For example, snorkels are known in which one end is integral with a mouthpiece and in which the other end comprises a bent tube whose opening can be obstructed by a ping-pong ball when this end crosses the level of the water. The swimmer then moves about while holding his breath, that is to say he stops breathing, and his stay under the water is limited by his lung capacity, since he can no longer supply himself with air.

On the other hand, diving apparatus is known in which the diver can be supplied from compressed air cylinders, the disadvantage being considerable weight and the need to refill the cylinders in a special-purpose station.

The present invention proposes to combine these two types of apparatus so as to enable a swimmer to move around equally well at the surface or at a shallow depth, while breathing continuously in the same way, by virtue of a nozzle allowing the supply of air, whether the swimmer is at the surface of the water or submerged.

When the swimmer is travelling at the surface, means for refilling a compressed air tank are provided so as to increase the duration of underwater observation, the weight of the apparatus remaining limited.

SUMMARY OF THE INVENTION

The proposed equipment enables swimmers and holiday makers to move around in the water in complete safety after very simple introductory training in the operation of the equipment. They will thus be able to learn about underwater life without, however, having to obtain a diver's license beforehand. The equipment according to the invention is therefore particularly simple and moreover free of danger since it comprises a limiter which hampers respiration once a predetermined depth is reached.

According to the invention, the self-contained diving equipment comprises a compressed air tank connected by a flexible air tube to a breathing nozzle, at least one external air intake connected by a tube to the breathing nozzle and ensuring the direct admission of surface air when this intake is not submerged, an injector provided with means for opening or closing the air tube coming from the tank and means for closing or opening the air tube coming from the external air intake, means for refilling the compressed air tank which are able to supply the tank when the diver is at the surface and to interrupt the supply during submersion, and by means for controlling the starting and stopping of said refilling.

In a preferred embodiment, the equipment moreover comprises a depth limiter associated with a depth sensor.

Preferably, all these components are held on the user's back by virtue of a jacket or straps which can also comprise an enclosure which can be inflated if need be in order to raise the swimmer.

In one embodiment, the means for refilling the tank comprise a motor supplied from batteries and driving a compressor connected to an external air intake. It is possible to provide a moisture removal device between the compressor and the tank and also an active carbon filter.

The control means comprise a moisture detector making it possible to check whether the compressor is in the water so that it enjoys good cooling.

The appended drawing represents, by way of example, an embodiment of the subject of the present invention.

DESCRIPTION OF A PREFERRED EMBODIMENT

Figure 1:
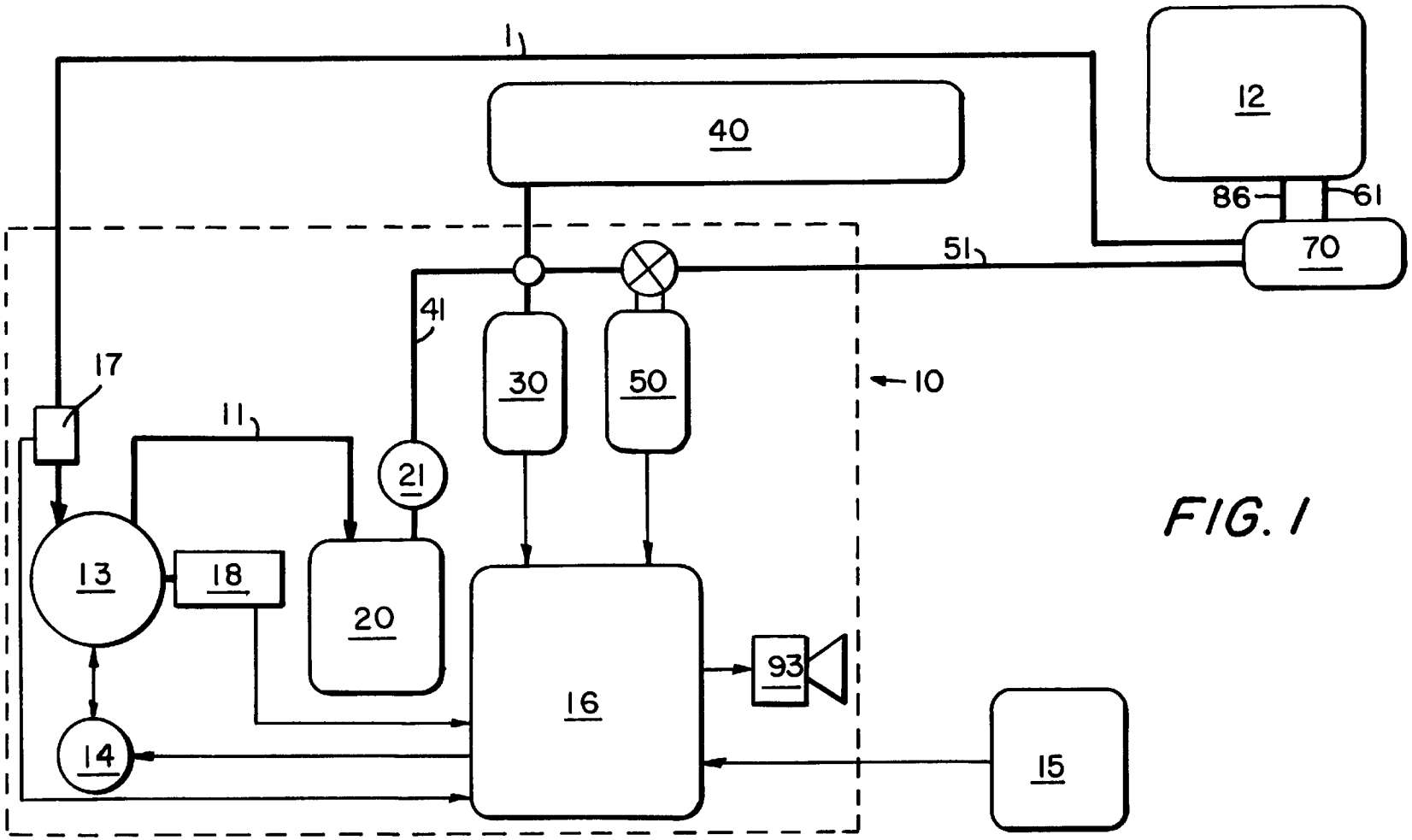
FIG. 1 is a schematic view of the principal constituents of an item of self-contained equipment according to the invention.

In the drawing of FIG. 1, the components grouped together inside the rectangle 10 constitute means for refilling with compressed air, which take in the external air via the tube 1 coming from the snorkel 12.

As a variant, the tube 11 can be connected directly to a compressed air reserve which is independent of the swimmer and which thus makes it possible to refill the tank 40 with the aid of a cylinder.

The compressed air passes in succession through a moisture removal device 20 and a carbon filter 21 before being fed into a tank 40. On leaving the tank, the pressurized air passes through a pressure sensor 30 and also a depth sensor associated with a depth limiter 50 before arriving, via a flexible hose 51, at the breathing nozzle 70, which can also receive surface air directly via a flexible hose 61 leading into a snorkel 12.

The means 10 for refilling with compressed air comprise a snorkel 12 which conveys the air taken in at the surface to a compressor 13 actuated by a motor 14 supplied from a pack of removable batteries 15. The air is compressed to 12 bar and leaves via the tube 11 heading for the moisture removal device 20 and the active carbon filter 21. Control means 16 are moreover subject to moisture detectors 17 and 18, integral with the compressor 13, and so that the compresson is in the water at the time that the motor started up by the control 16.

Start-up occurs only when the assembly is submerged and when the aqueous link between the electrodes maintains a closed contact (cue sent by detectors 17, 18).

Figure 2:
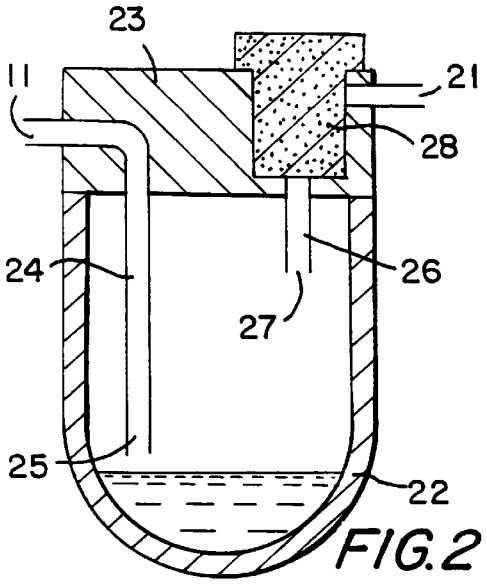
FIG. 2 is a transverse section through a moisture removal device and through an active carbon filter.

The device 20 for moisture removal and for filtering 21 is represented in FIG. 2 and makes it possible to recover the condensation arising from the difference in temperature between the compressor 13 (which is at around 60° C.) and the aquatic medium (around 20° C.). This device provides the user with dry air devoid of impurities which are harmful to respiration. It comprises a receptacle 22 which can be removed with respect to a cover 23 constituting a support. The cover 23 makes it possible to connect the tube 11 to a bent inlet passage 24 provided with spray holes 25 in its lower part. The cover also supports a bent outlet passage 26 comprising suction holes 27. This outlet passage passes through an active carbon filter 28 and providing for the filtering of impurities. The dry air emerges via the tube 21 to the pressure sensor 30 (FIG. 1).

Figure 3:
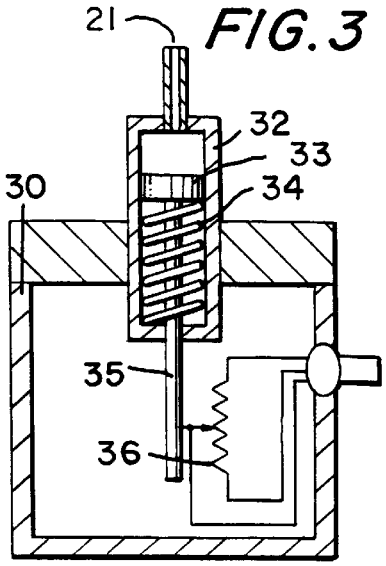
FIG. 3 is a section through an air pressure sensor whose piston is associated with a variable resistor and whose measurement cue is returned to a control.

The pressure sensor 30 shown schematically in FIG. 3 is branched off from the tube 21 of FIG. 1, which opens out into an enclosure 32 containing a piston 33 which can move against a spring 34. When the air arriving via the tube 21 displaces the piston downward to the maximum, the rod 35 of the piston drives the variable resistor 36, the cue from which triggers the stoppage of the compressor 13 by way of the control 16 represented in FIG. 1.

When the diver uses air while submerged and when the pressure is decreasing in the enclosure 32, the piston rises and the rod 35 drives the variable resistor 36, the cue from which actuates a buzzer 93 by way of the control 16, represented in FIG. 1, to signal to the diver that he is running on the air reserve.

Indeed, when the pressure is insufficient, the piston 33 is held back by the spring 34 which is calibrated to 0.8 bar. As soon as the pressure rises, the piston moves linearly, until a maximum pressure of 12 bar is reached, at which value it switches off the compressor by way of the control 16.

The enclosure 40 constitutes the air tank carried by the diver.

Figure 4:
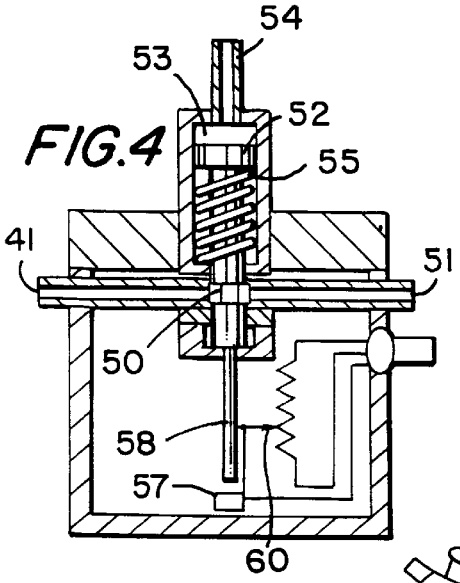
FIG. 4 is a section through a depth sensor whose piston is associated with a variable resistor as well as with a depth limiter and whose measurement cue is returned to a control.

The depth sensor associated with the depth limiter 50 is provided to prevent a novice from descending to levels which call for the observance of decompression stages and also problems of pulmonary overpressure during ascent, and it is designed to limit the use of the equipment to above a depth of around 5 meters. As may be seen in FIG. 4, this limiter comprises a piston 52 arranged in an enclosure 53 and comprising an opening 54 to the outside. The piston is held back by the spring 55 which is calibrated to 0.5 bar. The piston 52 comprises a restriction represented in the drawing substantially level with the tubes 41 and 51, in which position the air passes easily through the limiter. At a pressure of greater than 1.5 bar, the piston continues to descend, progressively closing the passage between the tubes 41 and 51. The piston is limited in its travel by the mechanical stop 57, in a position which ensures reduced air passage between the tubes 41 and 51. The diver has difficulty breathing and is aware that he merely needs to ascend above the maximum depth permitted. Furthermore, the rod 58 of the piston drives the variable resistor 60, the cue from which is sent to the control 16 so as to process and record the submersion profile. The control 16 triggers a buzzer or an audible alarm 93.

Figure 5:
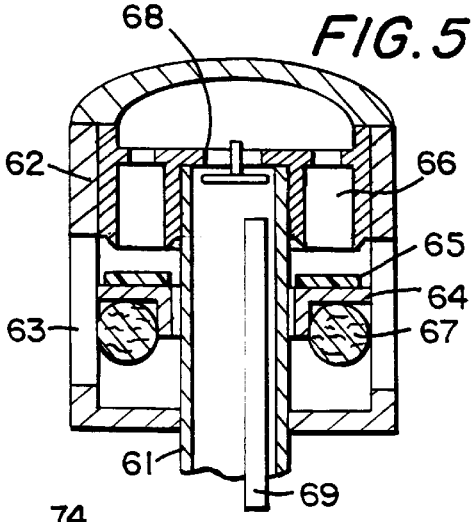
FIG. 5 is a section through a snorkel comprising the air intake required by the diver as well as the air intake required by the compressor.

The snorkel 12 represented in FIG. 5 consists of a cylindrical enclosure 62 for closing the tube 61, which enclosure comprises passages 63 which provide for air intake from outside. The enclosure 62 houses a movable float 64 provided, in its upper part, with a seal 65 intended to close off the openings 66 connecting with the tube 61 and, in its lower part, with a buoyancy ring 67, made for example of cork. The position represented in the drawing is that in which the external air passes into the tube 61 through the passages 63 and the openings 66. A valve 68 provides for the water-tightness of the tube 61 in the submersion mode. A hose 69 supplies the compressor with air.

On diving, the float 64 closes the openings 66 and during submersion it is the hydrostatic pressure acting on the surface of the assembly 64 which keeps the assembly in the closed position.

Figure 6:
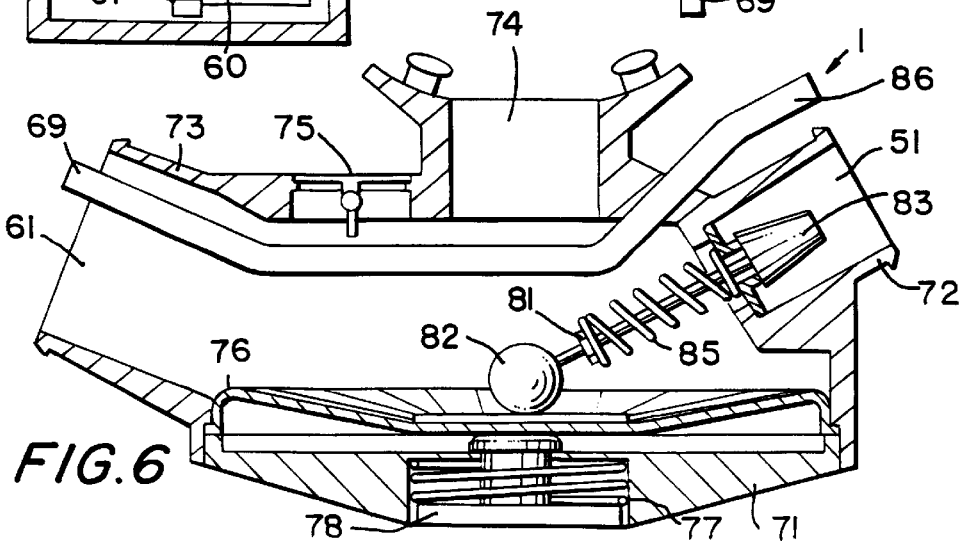
FIG. 6 is a section through the nozzle comprising the whole of the underwater breathing part and the air intake required for surface respiration correctly speaking and its surface/underwater convertor.

The breathing nozzle 70 is represented in section in FIG. 6. The enclosure 71 is provided with the following elements:

a first nozzle 72 enabling connection of the tube 51 conveying the air from the tank 40, a second nozzle 73 for connection of the tube 61 which directly conveys the surface air entering the snorkel 12, a breathing mouthpiece 74, an exhalation valve 75, a hydrostatic diaphragm 76 which can move under the action of the pressure in the opening 77 and a pushrod 78 which enables the enclosure to be purged manually. All these components being fully known to those skilled in the art, their set-up will not be described in detail here.

The displacement of the hydrostatic diaphragm 76 acts on an injector 81, 82, 83 and 85 which is as already mentioned provided with means for opening or closing the tubes 72 and 73. More precisely, in the embodiment represented in FIG. 6, the injector consists of a rod 81 having a spherical end 82 and a frustoconical end 83, the rod 81 passing through a cylindrical cage (not shown) which also accommodates a spring 85.

When the diver is at the surface, the injector is in the position represented in the drawing, the compressed air arriving via the tube 51 pushes the frustoconical end 83 which bears against the upper part of the cylindrical cage 84, closing the first nozzle 72 and consequently the tube 51. At the surface, the diver receives atmospheric air directly via the tube 61, which air passes through the snorkel 12 and can be breathed through the breathing mouthpiece 74. On exhalation, the diver discharges the gas via the exhalation valve 75.

In submersion mode detector 18 submerged), the snorkel 12 is closed and when the diver breathes he causes a pressure reduction in the enclosure 71. The hydrostatic diaphragm 76 moves inward, pushing the spherical end 82 upward, thereby displacing the rod 81 and consequently the frustoconical end 83, which opens the passage in the nozzle 72 for connection to the tube 41 and 51, conveying the air from the tank 40. The compressed air arriving in the enclosure 71 pushes the diaphragm 76 back downward and, under the action of the spring 85, the injector returns to the position represented in the drawing. This represents a situation of servocontrol and hydrostatic equilibrium.

A tube 86 passing through the enclosure 71 takes external air from the snorkel 12 and sends it to the compressor 13 via the tube 1.

As already mentioned, the majority of the components described are held on the user's back by virtue of a jacket or straps, which are not represented in the drawing, with the exception of the nozzle 70 and the snorkel, the tubes 51 and 1 consisting of flexible hoses. Furthermore, the jacket can include an enclosure which can be inflated by virtue of a carbon dioxide canister so as to raise the diver. As a variant, provision may be made to inflate this kind of buoy automatically when the air pressure in the tank drops below a predetermined threshold.

Returning to the general view of FIG. 1, the presence will also be noted of the emitter of acoustic signals 93, actuated by the control 16 which receives the cue from the sensor 30 when the pressure of the compressed air decreases, and the cue from the depth sensor 50 when the swimmer descends below the predetermined depth threshold. It will also be recalled that the previously mentioned moisture detector 18 comprises electrodes which, when they are in the water, close a contact, permitting the motor 14 to be started only when the assembly is submerged.

What is claimed is:

1. Self-contained diving equipment comprising:

a compressed air tank, a breathing nozzle, a first flexible air tube connecting the compressed air tank to the breathing nozzle to supply air to the breathing nozzle;

an external air intake a compressor, a second tube connecting the compressor to the compressed air tank to supply air to the tank, apparatus for operating the compressor for refilling the compressed air tank when the external air intake is not submerged and to interrupt the refilling of the compressed air tank when the external air supply is submerged including a device for controlling starting and stopping refilling of the tank;

a third tube connecting the external air intake to the breathing nozzle for insuring direct admission of surface air to the external air intake when the external air intake is not submerged; a fourth tube for supplying air from the external air intake to the compressor;

a snorkel between the external air intake and the third tube to the breathing nozzle and between the external air intake and the compressor, the snorkel provided with first means for opening and closing the third tube between the external air intake to the snorkel and the breathing nozzle and with second means for opening and closing the fourth tube connecting the external air intake to the compressor.

2. The diving equipment of claim 1, wherein the apparatus for operating the compressor comprises a motor for driving the compressor and batteries for operating the motor, the compressor being connected to the external air intake of the snorkel.

3. The equipment of claims 2, further comprising a moisture removal and filtering device comprising a carbon filter between the compressor and the compressed air tank.

4. The equipment of claim 2, further comprising a control device for the compressor motor, the control device comprising a piston having a shaft, a variable resistor subject to the acts of the shaft and connected with the motor for controlling the motor.

5. The equipment of claim 4, further comprising a moisture detector connected with the control device for the compressor motor.

6. The equipment of claim 1, further comprising a depth sensor for sensing the depth of the snorkel, a depth limiter connected with the depth sensor and operable to give a cue to both for operating the snorkel and to limit breathing flow rate when a preset depth is exceeded.

7. The equipment of claim 1, further comprising an emitter of an acoustic alarm signal operable when the snorkel is at a set depth.

8. The equipment of claim 1, further comprising a support adapted to engage a wearer of the equipment.

9. The equipment of claim 1, wherein the snorkel includes the external air intake and both the third and the fourth tubes having a respective inlet for air in the snorkel;

the first and second means being in the snorkel and operable to close the third and fourth tubes upon submersion of the snorkel.

10. The equipment of claim 9, wherein the fourth tube passes through the breathing nozzle to the compressor.

11. The equipment of claim 9, wherein the snorkel has a chamber communicating into the breathing nozzle and the inlet to the fourth tube being in the chamber, whereby air in the breathing nozzle is available to the inlet to the fourth tube for a time after the first means has closed the third tube.

* * * * *